US009010159B2

(12) United States Patent
Sharp

(10) Patent No.: US 9,010,159 B2
(45) Date of Patent: Apr. 21, 2015

(54) LAUNDRY TREATING APPLIANCE WITH TUB RING

(75) Inventor: Brenner M Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1102 days.

(21) Appl. No.: 13/017,411

(22) Filed: Jan. 31, 2011

(65) Prior Publication Data

US 2011/0247373 A1 Oct. 13, 2011

Related U.S. Application Data

(60) Provisional application No. 61/323,596, filed on Apr. 13, 2010.

(51) Int. Cl.
*D06F 23/04* (2006.01)
*D06F 37/12* (2006.01)
*D06F 37/24* (2006.01)

(52) U.S. Cl.
CPC ..... *D06F 37/245* (2013.01); *D06F 23/04* (2013.01); *D06F 37/12* (2013.01)

(58) Field of Classification Search
CPC ..... D06F 23/04; D06F 37/245; D06F 37/12
USPC ..... 68/23 R, 23.3, 24, 23 A, 139, 142
See application file for complete search history.

(56) References Cited

U.S. PATENT DOCUMENTS 2,966,051 A 12/1960 Gerhardt
3,029,623 A 4/1962 Morey
3,176,484 A * 4/1965 Shelton ..... 68/196
3,390,554 A 7/1968 Morgan
3,509,741 A * 5/1970 Morey ..... 68/27
3,585,822 A * 6/1971 Worst ..... 68/23.7
3,603,118 A 9/1971 Brucken et al.
3,716,122 A 2/1973 Baker et al.
4,054,412 A * 10/1977 Brummett et al. ..... 8/158
4,502,303 A 3/1985 Wasemann
5,377,508 A 1/1995 Hair et al.
5,713,221 A 2/1998 Myers et al.
5,782,110 A * 7/1998 Kim ..... 68/23.3
6,016,672 A * 1/2000 Kim et al. ..... 68/53
6,189,171 B1 * 2/2001 Savkar et al. ..... 8/159
6,241,781 B1 * 6/2001 Han ..... 8/159
6,351,974 B1 3/2002 Lyu et al.
6,516,485 B1 * 2/2003 Savkar et al. ..... 8/159
6,668,410 B2 12/2003 Lyu et al.
7,263,862 B2 9/2007 Lyu et al.
7,263,864 B2 9/2007 Lyu et al.
7,290,414 B2 11/2007 Houser et al.
2002/0189301 A1 * 12/2002 Hosoito et al. ..... 68/12.02
2005/0016226 A1 * 1/2005 Okazaki et al. ..... 68/12.04
2005/0284191 A1 12/2005 Turner et al.
2010/0170301 A1 * 7/2010 Back et al. ..... 68/23.1
2011/0120192 A1 * 5/2011 Song ..... 68/23.2
2012/0272692 A1 * 11/2012 Leibman et al. ..... 68/17 R
2012/0291496 A1 * 11/2012 Suel et al. ..... 68/134
2013/0042656 A1 * 2/2013 Ekbundit et al. ..... 68/5 C

FOREIGN PATENT DOCUMENTS

CN 1888243 A 1/2007
GB 663786 12/1951
WO WO 03023114 A1 * 3/2003 ..... D06F 33/02

* cited by examiner

*Primary Examiner* — Joseph L Perrin

(57) ABSTRACT

A laundry treating appliance having a tub with a tub ring and a drum located within the tub having a balance ring. The tub ring may extend radially inward and be spaced above the balance ring. The tub ring and balance ring may have an angled portion to provide for a generally constant space between the tub ring and balance ring during rotation of the drum within the tub.

6 Claims, 8 Drawing Sheets

LAUNDRY TREATING APPLIANCE WITH TUB RING

CROSS REFERENCE TO RELATED APPLICATIONS

The present application claims the benefit of U.S. Provisional Patent Application No. 61/323,596, filed Apr. 13, 2010, which is incorporated herein by reference in its entirety.

BACKGROUND OF THE INVENTION

Laundry treating appliances, such as clothes washers, clothes dryers, refreshers, and non-aqueous systems, may have a configuration based on a rotating drum that defines a treating chamber in which laundry items are placed for treating. In a vertical axis clothes washer, the drum and tub both have an opening defined by corresponding upper ends. A balancing ring can be coupled with the upper end of the drum to counter-balance a load imbalance that may occur within the treating chamber during a cycle of operation. Horizontal axis clothes washer may have two balancing rings; one on the front and one on the back of the drum. The balancing rings can have single or multiple chambers, which may contain one or more balancing materials, such as water, oil, and metal balls. A tub ring extending from the upper end of the tub can be provided for hiding the balancing ring from view and preventing the user from accidentally placing clothes between the tub and the drum during loading of the laundry items.

SUMMARY OF THE INVENTION

The invention relates to a laundry treating appliance comprising a tub, with a drum located within the tub. A tub ring is mounted to a peripheral edge of the tub and has a radially minimum point relative to a first deflection-induced point of rotation for the tub to define a first arc by a radius line extending from the first deflection-induced point of rotation to the radially minimum point and rotated about the first deflection-induced point of rotation. A balancing ring is mounted on the drum's peripheral edge and has a radially maximum point relative to a second deflection-induced point of rotation to define a second arc by a radius line extending from the second deflection-induced point of rotation to the radially maximum point and rotated about the second deflection-induced point of rotation. The tub ring and balancing ring are shaped such that a first arc and the second arc do not intersect at least over an arc length where sufficient for the tub and drum to contact each other during relative rotation of the tub about the first deflection-induced point of rotation and the drum about the second deflection-induced point of rotation.

DESCRIPTION OF EMBODIMENTS OF THE INVENTION

Figure 1:
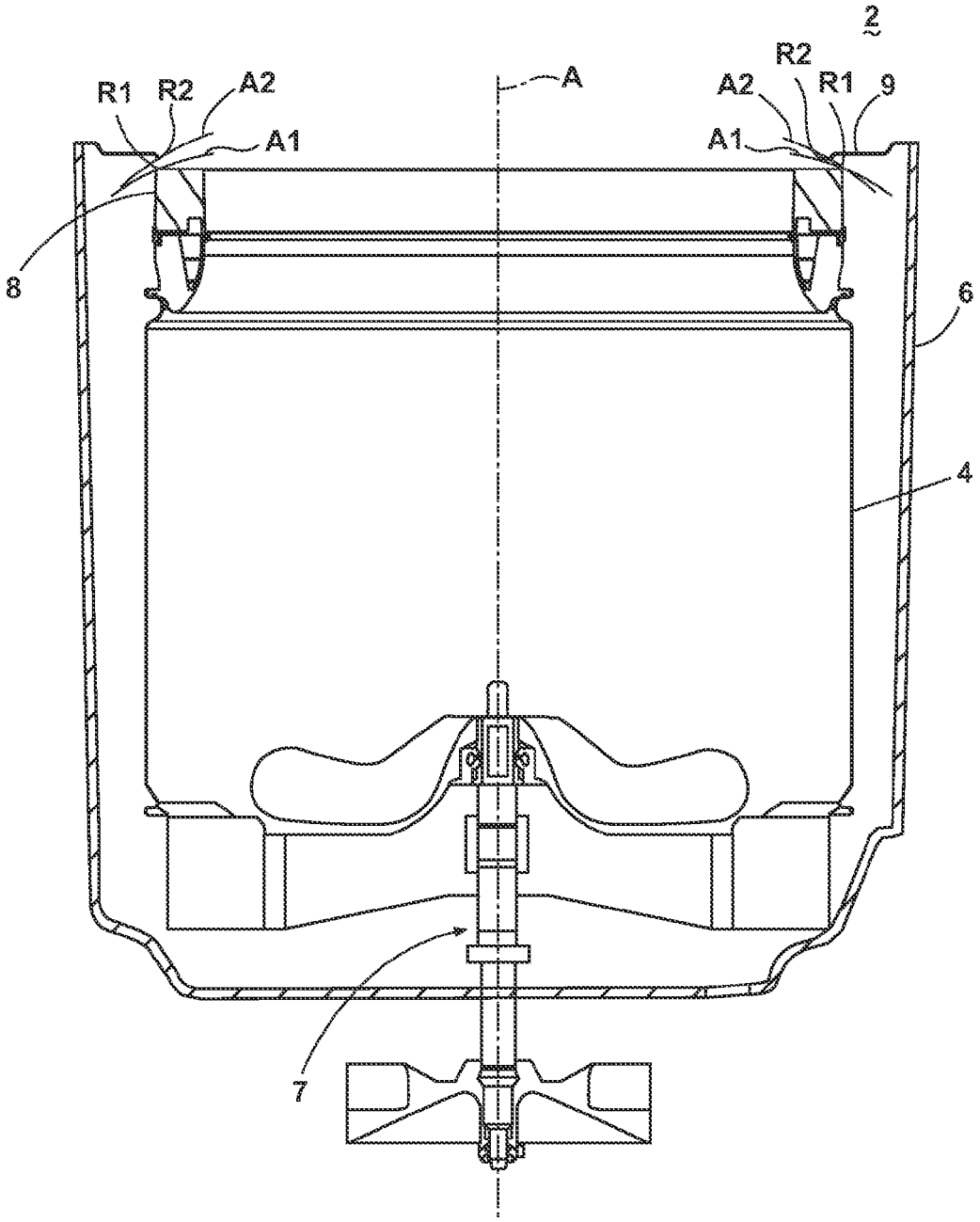
FIG. 1 is a schematic view of a laundry treating appliance having a drum located within a tub, according to the prior art.
Figure 2:
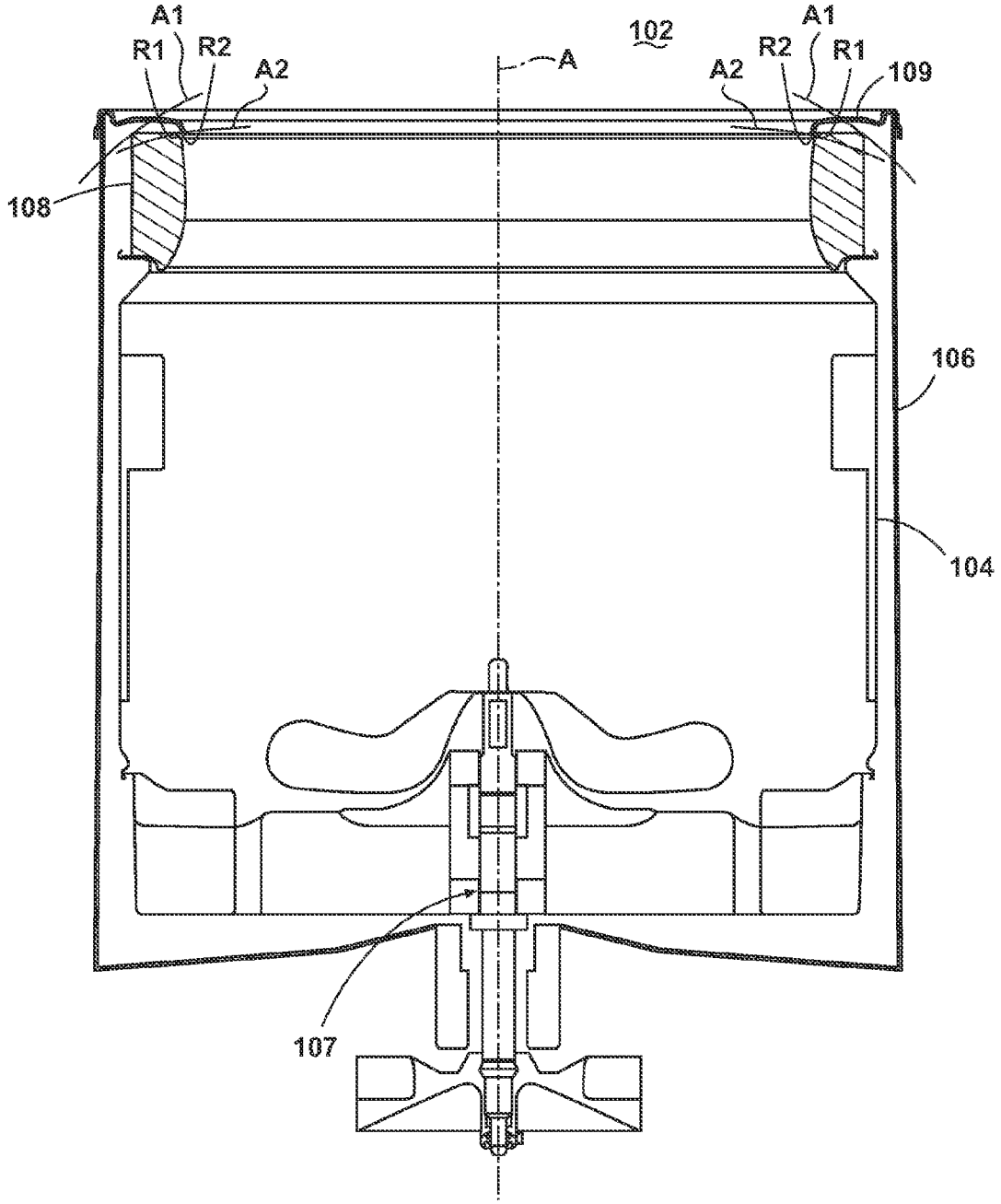
FIG. 2 is a schematic view of a laundry treating appliance having a drum located within a tub, according to the prior art.

FIGS. 1 and 2 illustrate two examples of the structure of a vertical axis clothes washer 2, 102, illustrating the problem overcome by the invention. The clothes washer 102 illustrated in FIG. 2 is similar to the clothes washer 2 illustrated in FIG. 1. Therefore, like parts will be identified with like numerals increased by 100, with it being understood that the description of the like parts of the clothes washer 2 of FIG. 1 applies to the clothes washer 102 of FIG. 2, unless otherwise noted. The clothes washers 2, 102 have a drum 4, 104 mounted within a tub 6, 106 for selective rotation by a drive assembly 7, 107 about a rotation axis "A". A balance ring 8, 108 may be coupled with a peripheral edge of the drum 4, 104, which is illustrated as an upper end of the drum 4, 104. A tub ring 9, 109, having a generally planar cross-section, may be coupled with a peripheral edge of the tub 6, 106, which is illustrated as an upper end of the tub 6, 106 and extend radially inward and be spaced above the balance ring 8, 108.

It has been found that the generally planar construction of the tub ring 9, 109 provides a tub ring 9, 109 that is inherently flexible, which requires additional material to support the tub ring 9, 109, such as increased wall thickness and support ribs, for example. The additional support structure may also lower the natural frequency of the first two vibration modes of the drum 4, 104 and tub 6, 106, which further increases the need for additional material to support the drum 4, 104 and tub 6, 106, increasing the overall cost of the clothes washer 2, 102.

In addition, in response to off balance conditions attributable to the load during rotation of the drum 4, 104 about the axis A, the drum 4, 104 and tub 6, 106 may deflect relative to each other by relative rotation about a common location generally corresponding to where the drum 4, 104 is coupled with the drive assembly 7, 107, which may result in undesirable contact between the balance ring 8, 108 and the tub ring 9, 109. The relative rotation can be thought of as rotation about a second rotational axis "B". The relative rotation may include only the rotation of one of the drum 4, 104 and tub 6, 106 relative to the other. It may also include the simultaneously rotation of both the drum 4, 104 and tub 6, 106.

Figure 1A:
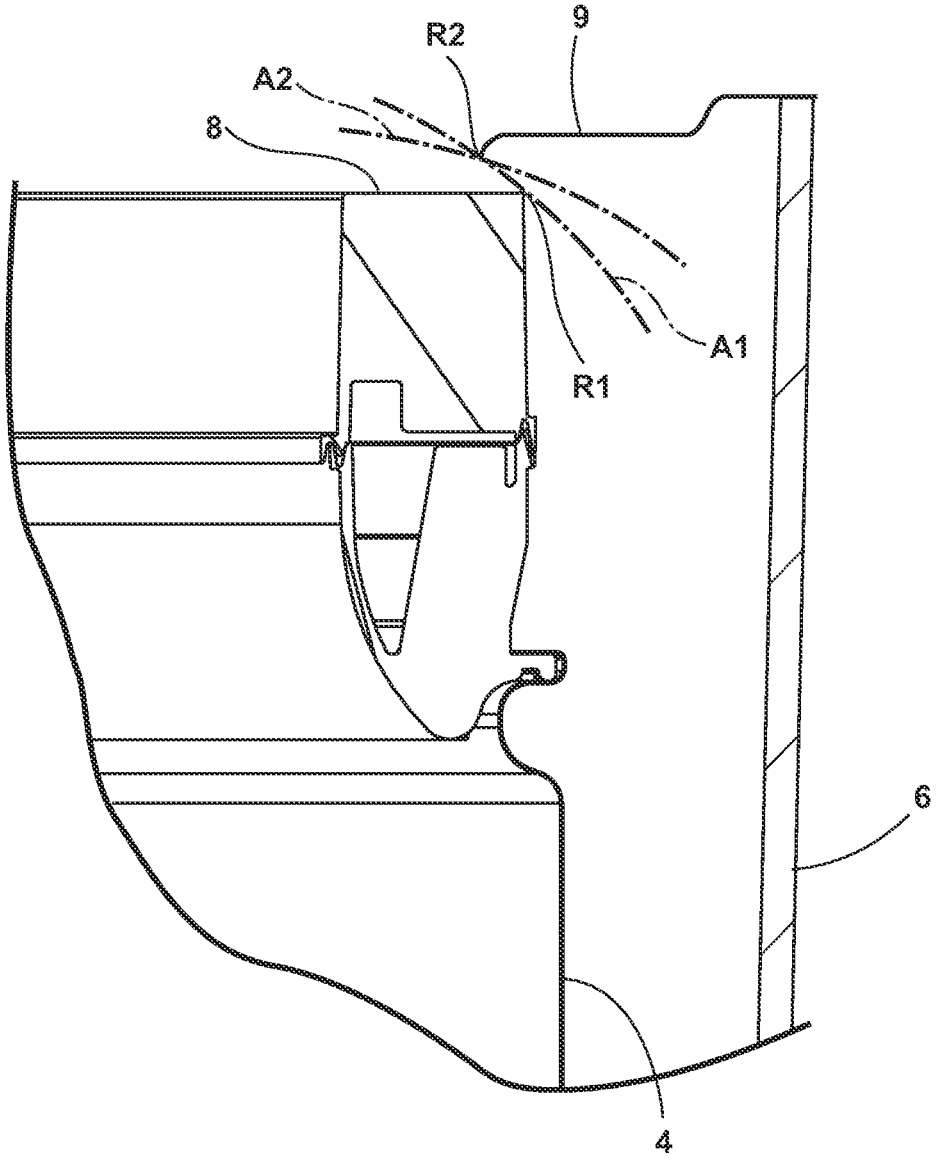
FIG. 1A is a detail view of the drum and tub of the laundry treating appliance shown in FIG. 1.
Figure 2A:
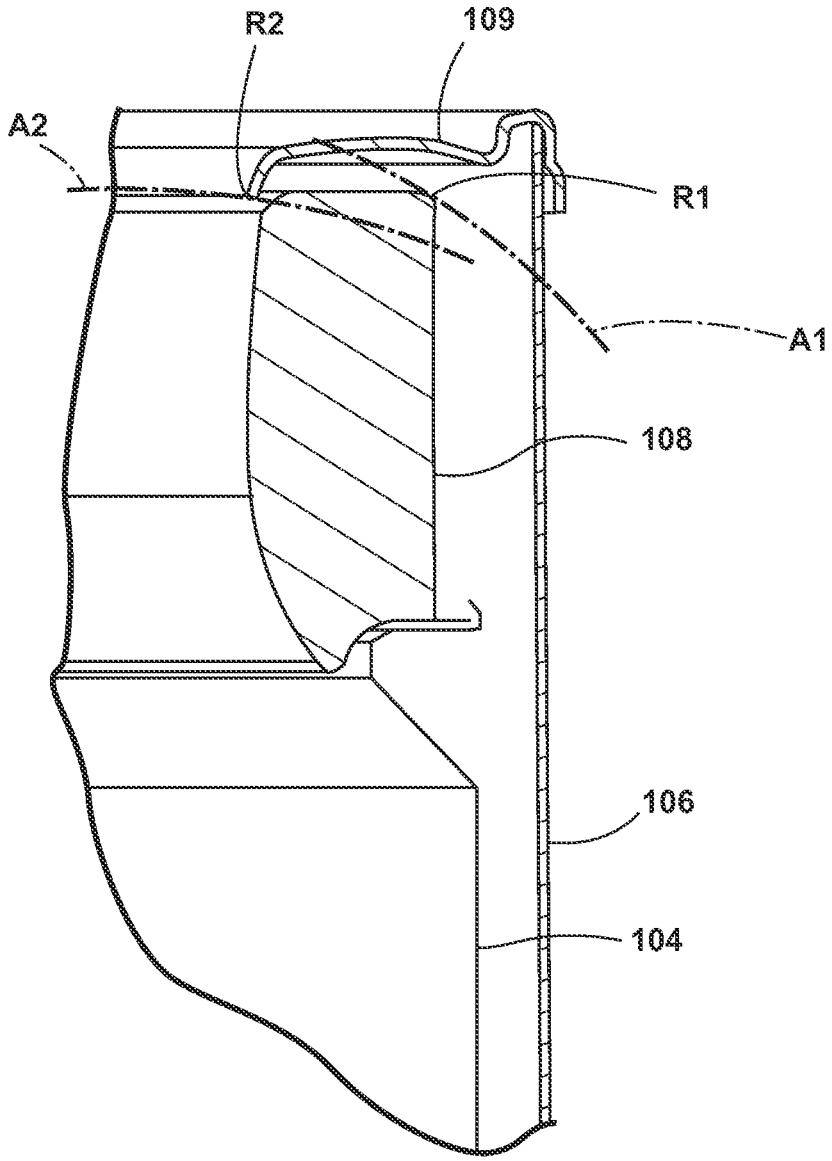
FIG. 2A is a detail view of the drum and tub of the laundry treating appliance shown in FIG. 2.

With rotation about a common point, each point on the balancing ring 8, 108 and tub ring 9, 109 effectively define a radius relative to the common point, and the radius may be rotated about the common point to define an arc. Any intersection of the plurality of arcs from the balancing ring 8, 108 and tub ring 9, 109 will indicate an area of possible interference or contact during rotation about the common point. Exemplary radii may be selected as the radially outermost point of the balancing ring, R1, and radially innermost point of the tub ring, R2, as illustrated in FIGS. 1 and 2, with a close up of corresponding arcs, A1 and A2, shown in FIGS. 1A and 2A. These exemplary radii represent the boundary of the possible contact areas. As can be seen, if the arcs A1 and A2 intersect, then deflection-induced rotation about the common point will result in contact between a portion of the balancing ring 8, 108 and the tub ring 9, 109.

While the relative rotation has been described as occurring about a common point, depending on the type of suspension and physical arrangement of the drum 4 and tub 6 to the drive system, it is possible for the drum 4, 104 and tub 6, 106 to rotate about different points. In such a situation, the radii R1 and R2 may be taken from their respective point of rotation.

This problem may be solved by controlling the relative shape of the tub ring 9, 109 and balancing ring 8, 108 such that the arcs A1 and A2 do not intersect at any point. However, it may not be necessary to prevent absolute intersection because at some point during the relative rotation of the tub 6, 106 and drum 4, 104, the tub 6, 106 and drum 4, 104 themselves will contact each other. Thus, the relative rotational amount of the tub 6, 106 and drum 4, 104 until they contact essentially defines a practical limit on the range of rotation, or arc length, over which one need be concerned about the tub ring 9, 109 and balancing ring 8, 108 contacting each other. Therefore, the tub ring 9, 109 and balancing ring 8,108 may be designed such that their arcs A1 and A2 do intersection, it is just that the intersection may be designed to occur at an arc length greater than the arc length where the tub 6, 106 and drum 4, 104 contact each other.

Figure 3:
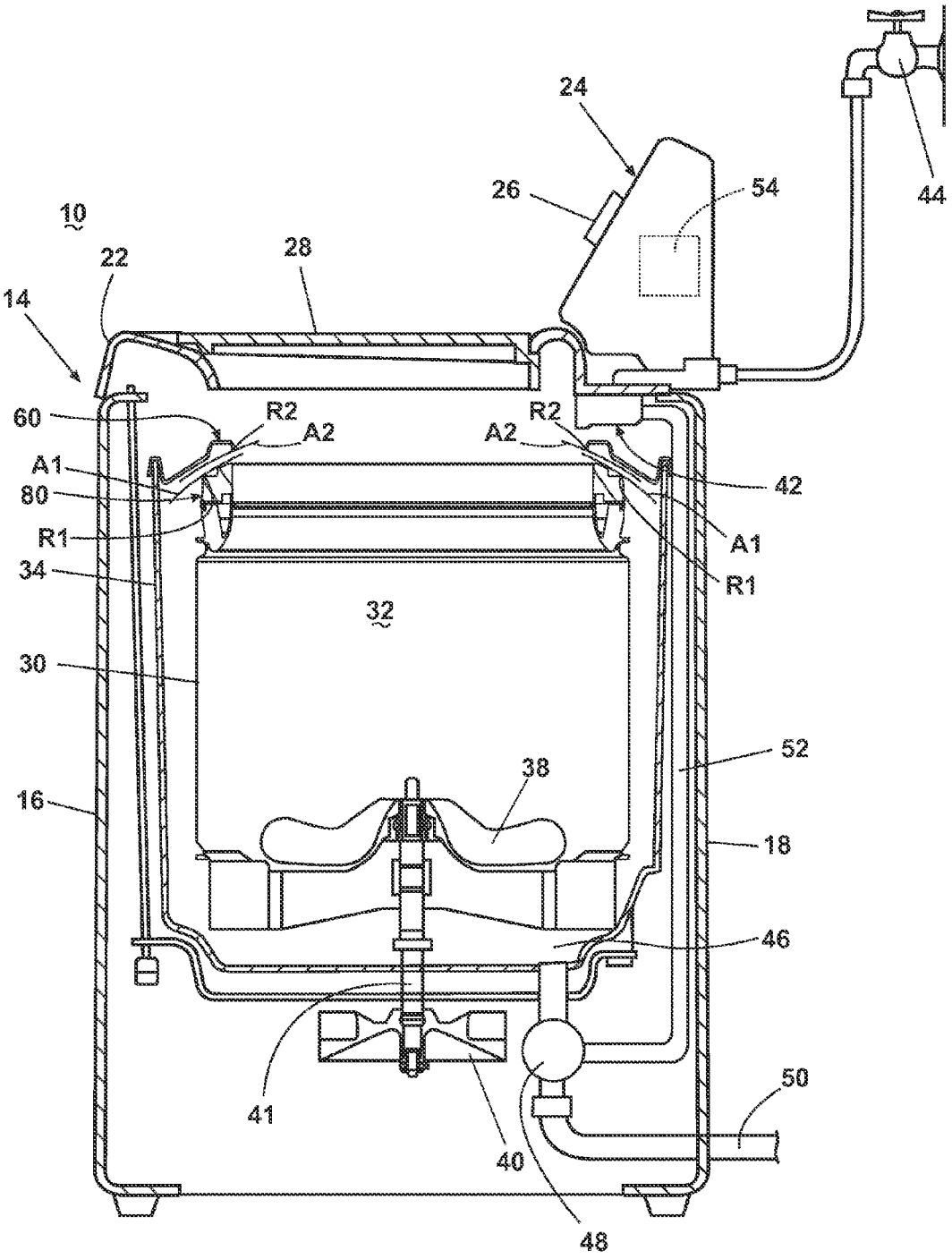
FIG. 3 is a perspective view of a laundry treating appliance having a tub ring coupled with a tub and a balance ring coupled with a drum located inside the tub according to one embodiment of the invention, with a portion cut-away to show interior components of the laundry treating appliance.

FIG. 3 is a perspective view of a laundry treating appliance 10 in the form of a washing machine according to one embodiment of the invention, which is configured to address the interference contact between the tub ring and the balancing ring. The laundry treating appliance may be any machine that treats articles such as clothing or fabrics, and examples of the laundry treating appliance may include, but are not limited to, a horizontal or vertical axis washing machine; a horizontal or vertical axis dryer, such as a tumble dryer or a stationary dryer; a tumbling or stationary refreshing/revitalizing machine; an extractor; a non-aqueous washing apparatus; and a revitalizing machine. The laundry treating appliance 10 described herein shares many features of a traditional automatic washing machine, which will not be described in detail except as necessary for a complete understanding of the invention.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

As illustrated in FIG. 3, the laundry treating appliance 10 may have a cabinet 14 defined by a front wall 16, a rear wall 18, a pair of side walls (not shown) and supporting a top wall 22. A user interface 24 on the cabinet 14 may have multiple controls 26, which may be used to select a cycle of operation. A chassis (not shown) may be provided, with the walls mounted to the chassis.

The top wall 22 may have an openable lid or door 28 and may be selectively moveable between opened and closed positions to close an opening in the top wall 22, which provides access to the interior of the cabinet 14. A rotatable drum 30 may be disposed within the interior of the cabinet 14 and defines a treating chamber 32 for treating laundry. The drum 30 may be positioned within an imperforate tub 34. The drum 30 may include a plurality of perforations (not shown), such that liquid may flow between the tub 34 and the drum 30 through the perforations. A clothes mover 38 may be located in the drum 30 to impart mechanical agitation to a load of clothing articles placed in the drum 30.

The drum 30 and/or the clothes mover 38 may be driven by an electrical motor 40 operably connected to the drum 30 and/or the clothes mover 38 by a drive shaft 41. The clothes mover 38 may be oscillated or rotated about its axis of rotation during a cycle of operation in order to produce high water turbulence effective to wash the load contained within the treating chamber 32. The motor 40 may rotate the drum 30 at various speeds in either rotational direction.

A liquid supply and recirculation system 42 may be provided to spray treating liquid, such as water or a combination of water and one or more wash aids, such as detergent, into the open top of the drum 30 and onto the top of a laundry load placed within the treating chamber 32. The liquid supply and recirculation system 42 may be configured to supply treating liquid directly from a household water supply 44 and/or from the tub 34 and spray it onto the fabric load. The liquid supply and recirculation system 42 may also be configured to recirculate treating liquid from the tub 34, including a sump 46, and spray it onto the top of the load. A pump 48 may be housed below the tub 34. The pump 48 may have an inlet fluidly coupled to the sump 46 and an outlet configured to fluidly couple to either or both a household drain 50 or a recirculation conduit 52. In this configuration, the pump 48 may be used to drain or recirculate wash water in the sump 46, which is initially sprayed into the drum 30, flows through the drum 30, and then into the sump 46.

Additionally, the liquid supply and recirculation system 42 may differ from the configuration shown in FIG. 3, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid. Further, the liquid supply and recirculation system need not include the recirculation portion of the system or may include other types of recirculation systems.

The laundry treating appliance 10 may further comprise a controller 54 coupled to various working components of the laundry treating appliance 10, such as the motor 40 and the pump 48, to control the operation of the working components. The user interface 24 may be coupled to the controller 54 and may provide for input/output to/from the controller 54. In other words, the user interface 24 may allow a user to enter input related to the operation of the laundry treating appliance 10, such as selection and/or modification of an operation cycle of the laundry treating appliance 10, and receive output related to the operation of the laundry treating appliance 10. Examples, without limitation, of cycles of operation include: wash, heavy duty wash, delicate wash, quick wash, refresh, rinse only, and timed wash. Any suitable controller 54 may be used. The specific type of controller is not germane to the invention. It is contemplated that the controller 54 may be a microprocessor-based controller that implements control software and sends/receives one or more electrical signals to/from each of the various components to effect the control software. As an example, proportional control (P), proportional integral control (PI), and proportional derivative control (PD), or a combination thereof, a proportional integral derivative control (PID control), may be used to control the various components.

Figure 4:
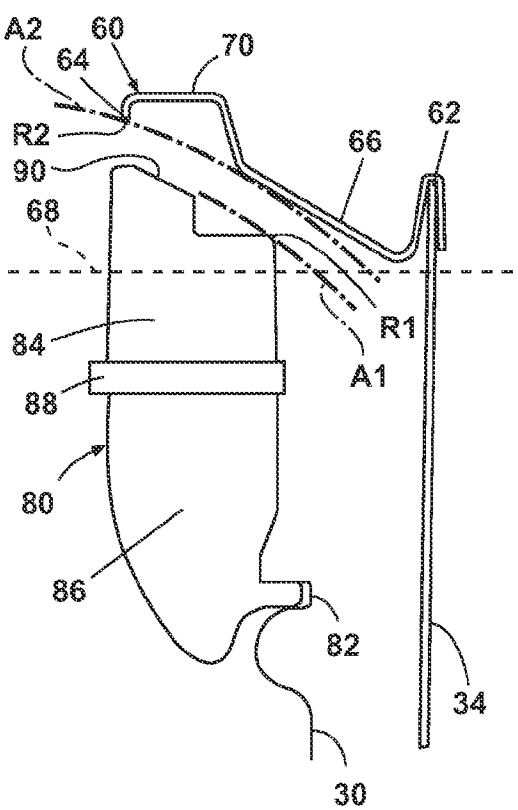

Referring now to FIG. 4, a tub ring 60 is coupled with and extends from a peripheral edge, which is illustrated as an upper end 62 of the tub 34. The tub ring 60 may be coupled with the tub 34 using any suitable mechanical and/or non-mechanical fastener, non-limiting examples of which include spring-clips, screws, and adhesives. The tub ring 60 defines an opening that is aligned with the opening in the top wall 22 to provide access to the treating chamber 32 (FIG. 3). The tub ring 60 extends over and beyond the drum 30 and terminates radially inward of the drum 30 at a distal end 64. The distal end 64 of the tub ring 60 defines the point R2, the exemplary radius may be selected as the radially innermost point of the tub ring 60 and which has a corresponding arc A2. The tub ring 60 may include a first portion 66 extending from the upper end 62 of the tub 34 at an angle of approximately 35 degrees from a horizontal reference line such as that defined by a horizontal plane 68, which is provided for illustrative purposes only. The distal end 64 may be coupled with the first portion 66 through a second portion 70, which may be an inverted groove. Alternatively, the first portion 66 may extend from the tub 34 to the distal end 64. The tub ring 60 may prevent wash liquid from running up the walls of the drum 30 and tub 34 and splashing out and prevents access by the user to the peripheral edge of the drum 30 and tub 34 when the door 28 is opened, which prevents the user from accidentally placing laundry in the tub 34 when loading laundry into the treating chamber 32.

The laundry treating appliance 10 may also include a balance ring 80 coupled with a peripheral edge of the drum 30, which is illustrated as an upper end 82 of the drum 30 to offset an imbalance that may occur in the treating chamber 32 during a cycle of operation. The balance ring 80 may be coupled with the drum 30 using any suitable mechanical and/or non-mechanical fastener, non-limiting examples of which include spring-clips, screws, and adhesives.

The balance ring 80 may include an upper annular chamber 84 and a lower annular chamber 86 that may be separated by a dividing wall 88. The lower annular chamber 86 may be partially filled with a first fluid, such as water, salt water, oil or other viscous fluid, for example. The upper annular chamber 84 may be partially filled with a second fluid, which may include water, salt water, oil or other viscous fluid, and a plurality of moveable weights, such as balls, for example (not shown). Alternatively, the balance ring 80 may include a single chamber that may be partially filled with a fluid, such as water, salt water, oil or other viscous fluid, for example, and optionally one or more moveable weights. The balance ring 80 may also include a chamfered upper face 90 on an upper portion of the balance ring 80. The chamfer of the upper face 90 may be approximately 35 degrees from the horizontal plane 68. Further, an exemplary radius may be selected as the radially outermost point of the balance ring 80, defining the point R1 which has a corresponding arc A1.

Figure 6:
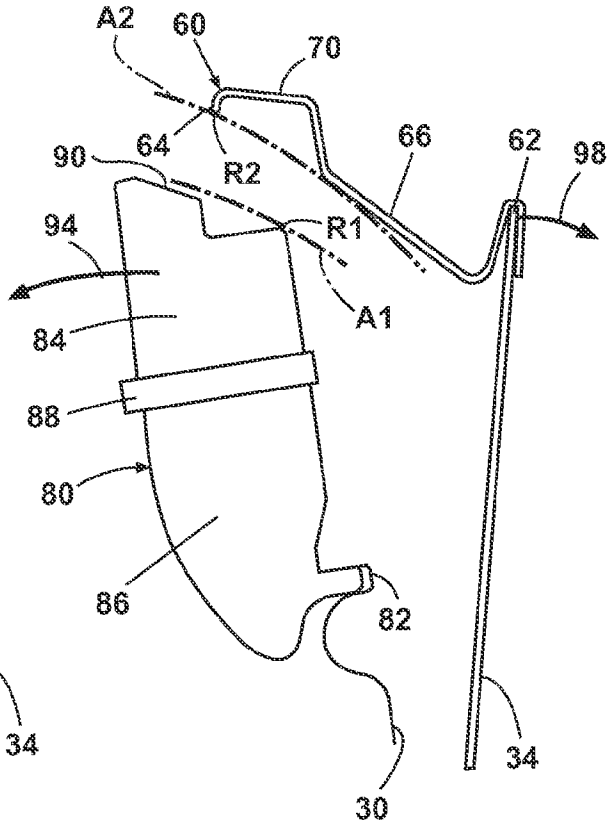
FIGS. 4, 5, and 6 are schematic views of a laundry treating appliance illustrating the motion of the tub, drum, tub ring and balance ring according to a second embodiment of the invention.
Figure 5:
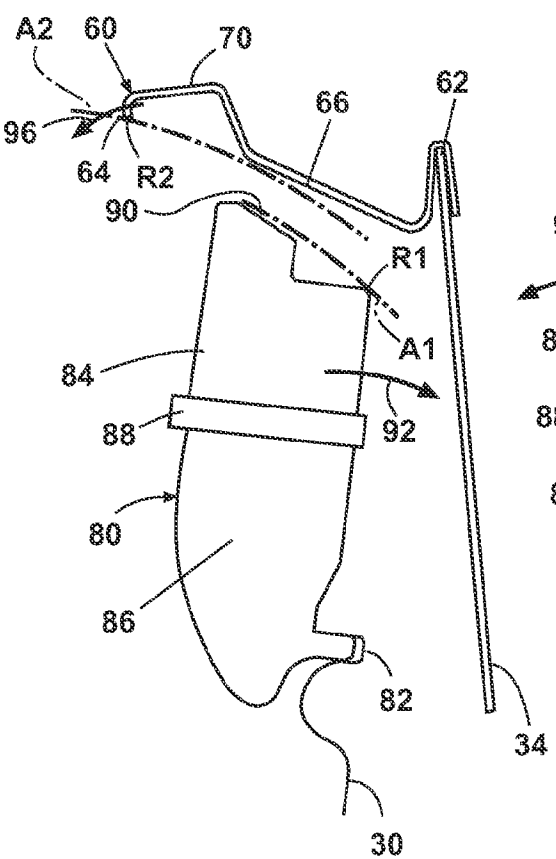

Referring now to FIGS. 4, 5, and 6, the movement of the tub 34, tub ring 60, drum 30 and balance ring 80 during rotation of the drum 30 during a cycle of operation is described according to an embodiment of the invention. The discussion of the movement of the tub 34, tub ring 60, drum 30 and balance ring 80 is for illustrative purposes only and is not meant to limit the embodiments of the invention in any manner.

As illustrated in FIG. 4, the tub ring 60 extends radially inward toward and is spaced above the balance ring 80 by a predetermined amount, which may vary depending on the specific laundry treating appliance and balance ring. The drum 30 and tub 34 are also spaced from one another by a predetermined amount, which may vary depending on the specific laundry treating appliance. As illustrated in FIGS. 5 and 6, during rotation of the drum 30, the drum 30 and tub 34 rotate about a common location generally corresponding to the position where the drum 30 couples with the drive shaft 41 of the motor 40 (FIG. 3). The drum 30 and balance ring 80 rotate radially outward and inward, as illustrated by arrows 92 and 94 as the tub 34 and tub ring 60 rotate radially inward and outward, as illustrated by arrows 96 and 98 in FIGS. 5 and 6, respectively.

It has been found that the angled first portion 66 of the tub ring 60 and the chamfered upper face 90 of the balance ring 80 help to maintain at least a portion of the space between the tub ring 60 and the balance ring 80 during movement of the drum 30 and the tub 34. Because the space between the tub ring 60 and the balance ring 80 is generally maintained during movement of the drum 30 and tub 34, potential contact points between the balance ring 80 and the tub ring 60 rotate past each other on circular arc paths, A1 and A2, that are angled at approximately 35 degrees from the horizontal plane 68 without contacting each other.

It has been found that the tub ring 60 having the angled first portion 66 experiences less distortion and warping during the molding operation of the tub ring 60 compared to a traditional, planar tub ring, such as that discussed above with respect to FIGS. 1 and 2. In addition, the shape of the tub ring 60 provides additional stiffness to the upper end 62 of the tub 34, which may also lower the natural frequencies of the wash unit and provide for reduced material usage, through the elimination of support ribs and decrease in wall thickness, in constructing the tub ring 60 and tub 34. The lower natural frequencies may also allow for the use of higher spin speeds. During high speed spin, any off balance in the system creates a rotating force that excites vibrational mode shapes in the wash unit. These vibrational modes dictate how the various parts and components in the wash unit deflect and move relative to one another.

Further, it has also been found that the use of the tub ring 60 having the angled first portion 66 provides additional space within tub 34 which may provide increased drum capacity. The tub ring 60 and balance ring 80 pass past one another, yet are able to maintain the designed gap, due to the angled first portion 66 of the tub ring 60 and the non-intersecting circular arc paths, A1 and A2. This allows the elimination of the use of vertical stack between the tub ring 60 and balance ring 80 to provide the designed clearance, which in turn allows the drum 30 to occupy that space, thereby, increasing the internal volume of the treating chamber 32.

Figure 7:
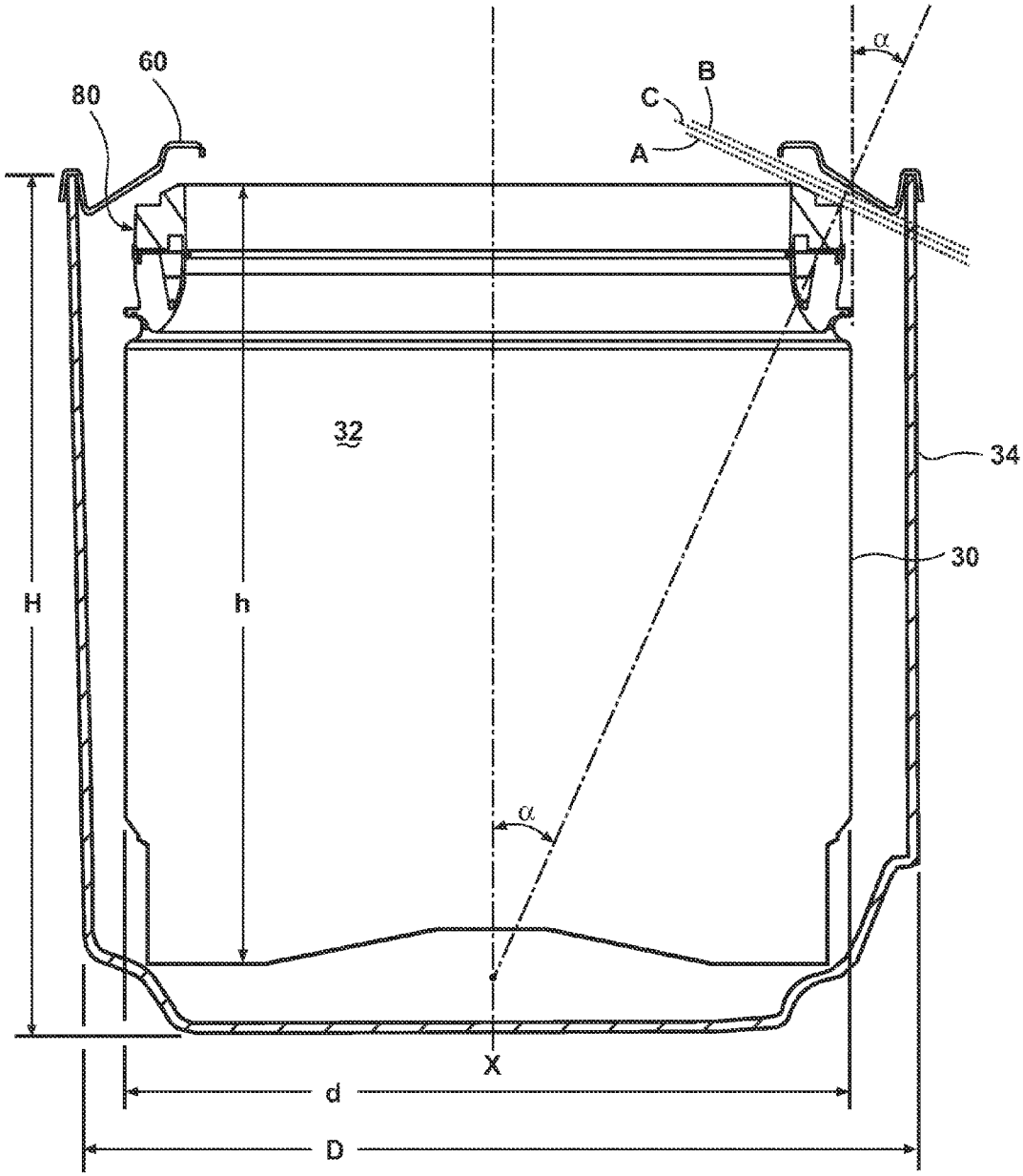
FIG. 7 is a schematic view of the laundry treating appliance of FIG. 3, illustrating the geometric relationship between the components.
Figure 8:
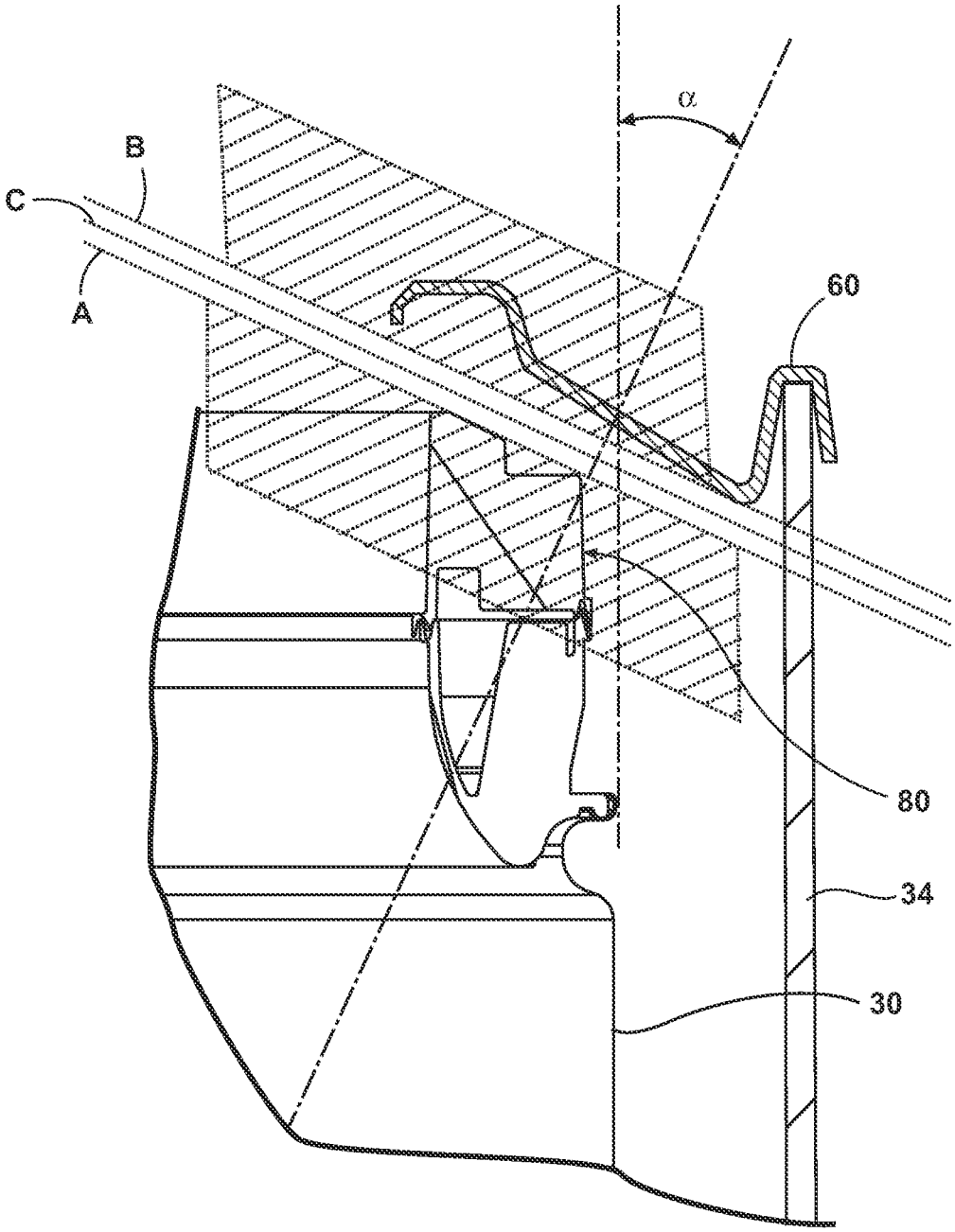
FIG. 8 is a detail view of the laundry treating appliance shown in FIG. 7.

Referring now to FIGS. 7 and 8, a schematic view of the laundry treating appliance 10 is illustrated to aid in the understanding of the geometric relationship between the relevant components of the appliance 10. As can be seen in FIG. 7, the tub 34 has a width D and a height H, and the drum 30 has a width d and a height h. The drum is rotatable about an axis of rotation X. Further, the balance ring 80 has a maximum point at which a tangent line A may be drawn and the tub ring 60 has a minimum point at which tangent line B may be drawn. A line of contact is defined by contact line C, located between the tangent lines A and B. Contact line C may be located anywhere between tangent lines A and B, even though it is illustrated at the average of tangent lines A and B.

A reference line can be drawn between the point of the axis of rotation X and a point on each of the tangent lines A and B. The reference line forms a right angle to the tangent lines A and B. Further, an angle alpha exists between a line parallel to the axis of rotation X and the reference line. The geometric relationship between the tub 34, drum 30, and contact line C can be described by the following equation:

$$\tan\alpha = 2 * \left(\frac{(H+h)}{(D+d)}\right)$$

The contact line C illustrates a limit where all portions of the tub ring 60 must line on one side of the contact line C, and all portions of the balance ring 80 must line on the other side of the contact line C. As can be seen in the figures, the tub ring 60 would necessarily be located above the contact line C and the balance ring 80 would be located below the contact line C. Configuring the geometric relationship between these components in this fashion ensures that the tub ring 60 and balance ring 80 will not interfere with one another when experiencing high spin speeds and movement, as described above. Although for illustrative purposes only, the shaded areas in FIG. 8 show the acceptable areas above and below tangent lines A and B in which the tub ring 60 and balance ring 80 are clear to be positioned.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a cabinet defining an interior;

a tub comprising a peripheral wall terminating in a peripheral edge to form an opening to an interior of the tub for holding liquid;

a drum located within the interior of the tub, comprising a peripheral wall terminating in a peripheral edge to form an opening to an interior of the drum for receiving laundry for treatment, and rotatable about an axis;

a tub ring mounted to the peripheral edge of the tub defining a first arc as the tub deviates from the axis about a first point, the tub ring having a first angled portion extending inwardly and upwardly from the peripheral edge of the tub at a first angle; and a balancing ring mounted on the peripheral edge of the drum defining a second arc as the drum deviates from the axis about a second point which is a common point with the first point, the balancing ring having a second angled portion extending inwardly and upwardly from the peripheral edge of the drum at substantially the first angle while the appliance is not operating, wherein the first and second angled portions are separated by substantially a minimum distance that generally prevents contact of the first and second portions while the appliance operates, and wherein the first and second arcs do not intersect while the appliance operates.

2. The laundry treating appliance of claim 1 wherein the angled portion of the tub ring overlies the peripheral edge of the drum.

3. The laundry treating appliance of claim 2 wherein the angled portion of the tub ring extends at an angle of about 35 degrees relative to a horizontal reference line.

4. The laundry treating appliance of claim 2 wherein the tub ring further comprises another portion that extends radially inward from the angled portion of the tub ring.

5. The laundry treating appliance of claim 4 wherein the tub ring further comprises a groove that receives the peripheral edge of the tub to mount the tub ring to the tub.

6. The laundry treating appliance of claim 1 wherein the first and second arcs never intersect.

* * * * *